United States Patent [19]

Kramer

[11] 4,174,019

[45] Nov. 13, 1979

[54] DUAL SPEAKER

[76] Inventor: Justin A. Kramer, 10 28 W. 8th Pl., Los Angeles, Calif. 90017

[21] Appl. No.: 888,200

[22] Filed: Mar. 20, 1978

[51] Int. Cl.[2] ...G10K 13/00; H04R 7/00 G10K11/00

[52] U.S. Cl. ..... 181/159; 181/145; 181/152; 181/188

[58] Field of Search ..181/159, 181/152, 155, 187, 188, 199, 144, 145, 146, 147; 179/115.5 H, 1 E

[56] References Cited

U.S. PATENT DOCUMENTS

| | | | |
|---|---|---|---|
| 1,602,969 | 11/1926 | Farwell | 181/159 |
| 1,750,900 | 3/1930 | Minton et al. | 181/188 |
| 1,785,377 | 12/1930 | De Forest et al. | 181/188 |
| 1,853,850 | 4/1932 | De Forest et al. | 181/159 |
| 1,930,915 | 10/1933 | Wento | 181/159 |

*Primary Examiner*—Stephen J. Tomsky

[57] ABSTRACT

A dual loudspeaker is set up to handle separately high frequency and low frequency sounds in the same piece of equipment. The apparatus comprises a single housing having a vertical partition dividing the housing into two chambers. A high-frequency driver in one chamber feeds into a relatively short horn path to a high frequency bell. A low-frequency driver in the other chamber feeds into a relatively longer horn path to a low-frequency bell. The high-frequency and low-frequency bells are located side by side on opposite sides of a partition and feed into a progressively expanding horn which serves simultaneously the output of both drivers.

9 Claims, 8 Drawing Figures

DUAL SPEAKER

Loud speakers for the dispersion of sounds generated by electronic means have generally one problem in common, namely that of even and uniform distribution of the sound in all directions. It is generally appreciated that for sounds of low frequency omni-directional distribution may not always be a troublesome problem but as the frequency of the sound increases the sound becomes increasingly more directional. Since high-frequency sound, especially in music, is extremely important to the overall program content, uniform distribution of such high-frequency sounds in all directions is very important. The importance of this is emphasized by reason of the fact that direct-radiator loudspeakers and simple horns tend to become more directional as the frequency of the sounds they produce become higher. This is quite generally undesirable for a loudspeaker because it means that the spectrum of music or speech as reproduced will vary from one position to another around the speaker. In other words, persons at one locality might receive these sounds in a perfectly acceptable way, whereas persons at another location not too far removed may receive the sounds very poorly and not receive some sounds.

An expedient which has been resorted to in the past has been to make use of what are called multi-cellular horns. Units of such character are customarily built with as few as two cells extending throughout a curved front, and as many as fifteen or more cells also extending throughout a curved front. Clearly, the more cells which are employed, the greater the directional distribution, inasmuch as each cell can account for an angle of distribution of only about 20°.

Even with a multi-cellular unit or multi-cellular horn, as they are commonly termed, there still remain problems because it is not practical to use such a design for other than relatively high frequencies (above 500 Hz) because the horn sections in order to be practical must be relatively short and very long horns are required for production of low frequencies. This defect has been remedied in some cases by having, in addition to the multi-cellular horns, one or more additional sets of transducers to cover the entire audio frequency spectrum. It is therefore, readily understandable that installations of such character can become extremely complex and expensive, and still fall short of uniform distribution of sound in all directions which is satisfactory for all frequency ranges.

It is, therefore, among the objects of the invention to provide a new and improved speaker which is simple, compact and substantially uniform in directivity for sounds throughout the entire range of audible frequencies.

Another object of the invention is to provide a new and improved speaker of simple, compact design which is capable of disbursing sound throughout a range of 180° and which can be extended to a directional distribution of substantially 360° by merely doubling the installation.

Another object of the invention is to provide a new and improved dual speaker unit for the dispersion of sounds generated electronically which is capable of producing a highly acceptable mixture of high and low frequencies at a single compact source and handled in a manner such that there is a widespread distribution of sound of all frequencies.

Still another object of the invention is to provide a new and improved dual speaker capable of a broad angle of distribution of sounds in the different frequency ranges which is relatively simple to build of substantially stock material, and which, by being limited to what amounts to no more than two compartments of different lengths for sounds of different frequency ranges, makes possible a construction which is relatively inexpensive, while at the same time without sacrifice of the desired broad directional distribution.

Still another object of the invention is to provide a new and improved dual speaker unit for the dispersion of sounds of both high and low frequencies wherein the ratio of path lengths of high frequency sound and low frequency sound can be readily varied to suit different needs, and without any appreciable change of the structural expedients.

Still further among the objects of the invention is to provide a new and improved dual speaker unit wherein the paths for sound travel of different frequency ranges are compactly contained within the same housing and carried side by side through the housing to a common sound dispersing horn, and preserving a package which is neat in appearance, occupies substantially a minimum amount of space, and which is well-adapted to different types of sound, and in particular, sounds such as those of electronic carillons.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 1 is a side elevational view partially broken away showing the dual speaker unit viewed from one side.

Figure 5:
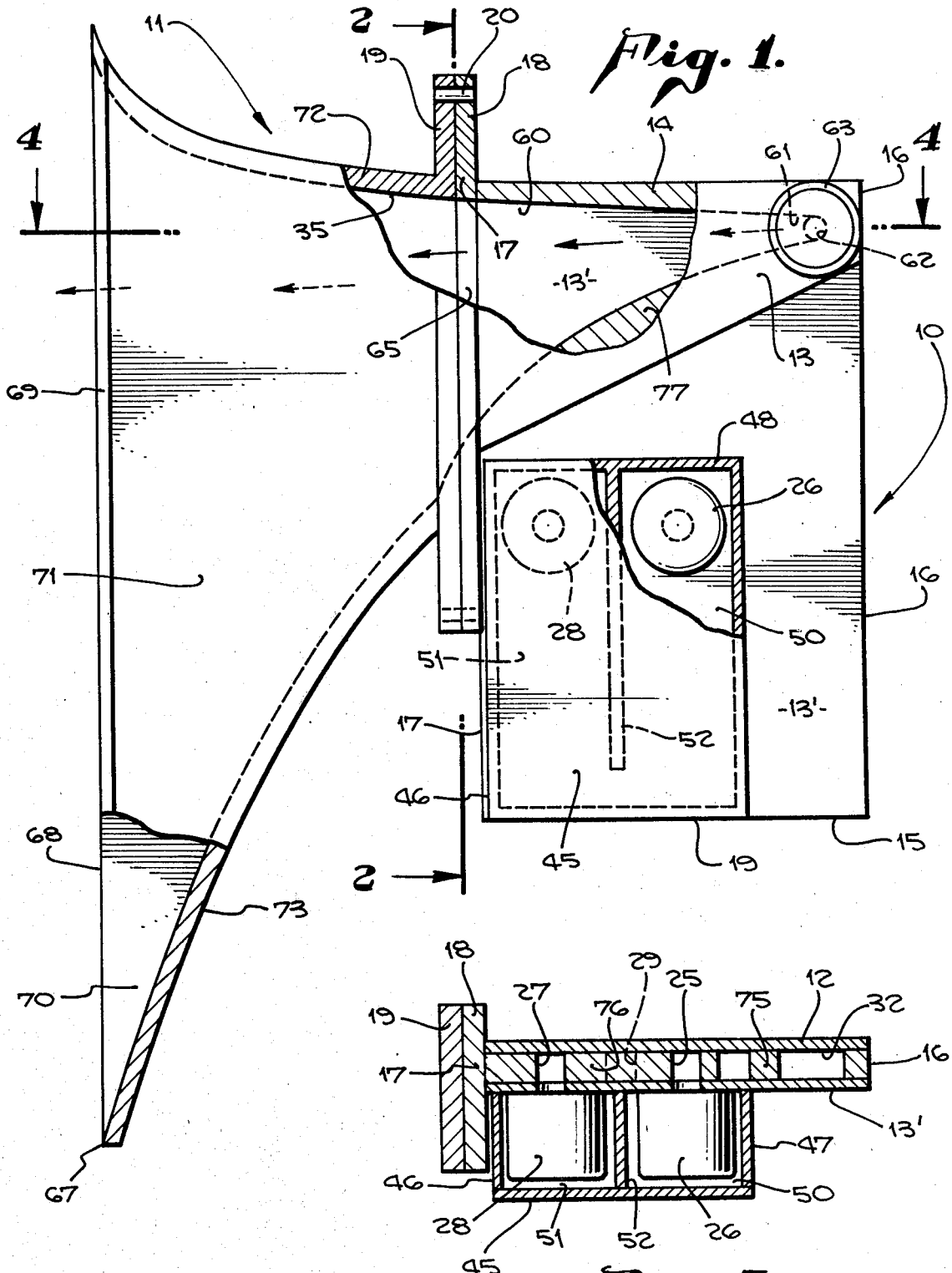
FIG. 5 is a cross-sectional view on the line 5—5 of FIG. 3.

In one embodiment of the invention which has been chosen for the purpose of illustration, there is shown a dual speaker unit consisting in the main of a speaker housing indicated generally by the reference character 10 on one side of which is mounted a single horn housing 11. The speaker housing as a matter of structural convenience consists of an exterior side wall 12, a top wall 14, bottom wall 15, rear wall 16 and front wall 17. On the side opposite the side wall 12 is a partial side wall 13 and a wall section 13' serving partly as an intermediate partition. On the front wall 17 is a flange 18 serving as part of an output wall structure and to which is attached a flange 19 of the horn housing 11, by means of appropriate fasterners 20, in this manner to join the horn housing and speaker housing as a composite unit.

The speaker housing 10 as a single housing accomodating simultaneously a relatively long horn section for sounds in the lower range of frequency and a relatively short horn section for sounds in the high range of frequency. Although there is no critical line of demarcation between sounds of a high frequency range and sounds of a low frequency range, a convenient separation is one wherein high range sounds are considered those of 500 hertz and up and low range sounds those below 500 hertz. This separation of frequencies appears to accommodate most requirements.

Figure 3:
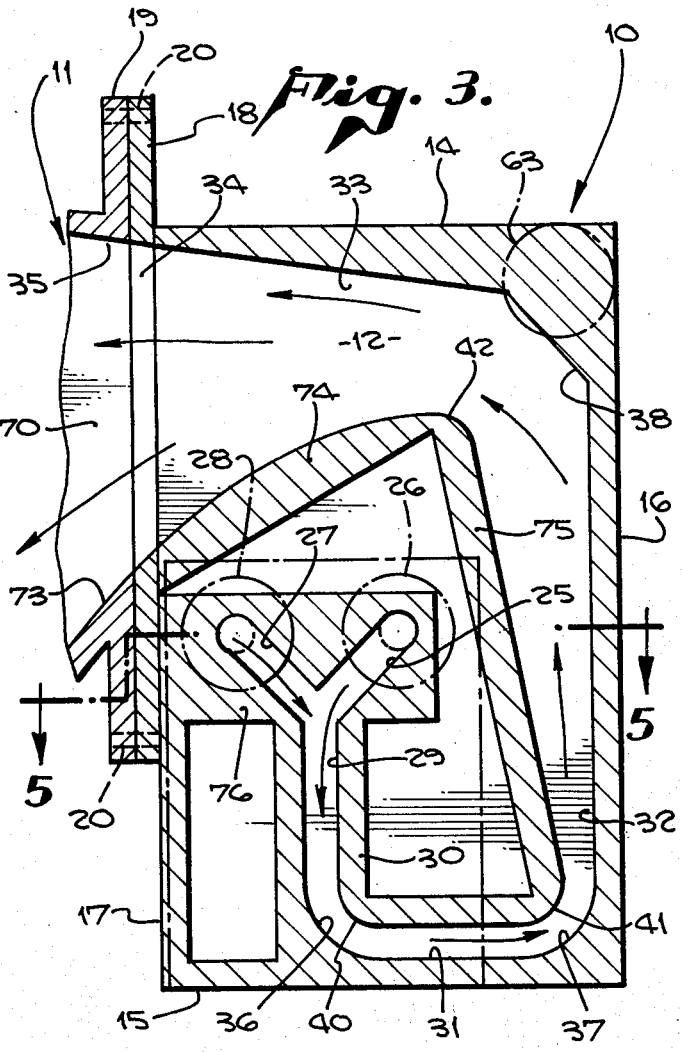
FIG. 3 is a side sectional view on the line 3—3 of FIG. 2.

The long horn for the low frequency sounds commences in a driver chamber 25 for one low range driver 26 and a second driver chamber 27 for a second low range driver 28. The driver chambers 25 and 27 feed into a common first horn section 29 which extends downwardly within a vertical structure 30 as shown in FIG. 3. The first horn section 29 feeds into a second horn section 31 running horizontally as pictured in FIG. 3 which in turn feeds into a progressively expanding third horn section 32 in which the low range sound travels upwardly. The third horn section 32 feeds into a progressively vertically expanding fourth horn section 33 from which it emerges to a low frequency opening 34. From the low frequency opening 34 sound is received by a throat 35 of the horn housing 11.

It is a matter of some moment that between the horn sections 29 and 31, where they join at a substantial right angle, there is provided a rounded section 36. A second rounded section 37 is located at the junction of the second horn section 31 with the third horn section 32. A deflector 38 resides at the junction of the third horn section 32 with the fourth horn section 33. Beveled corners 40, 41 and 42 opposite the respective rounded sections 36, 37 and deflector 38 smooth out the path of the horn section just described.

Figure 2:
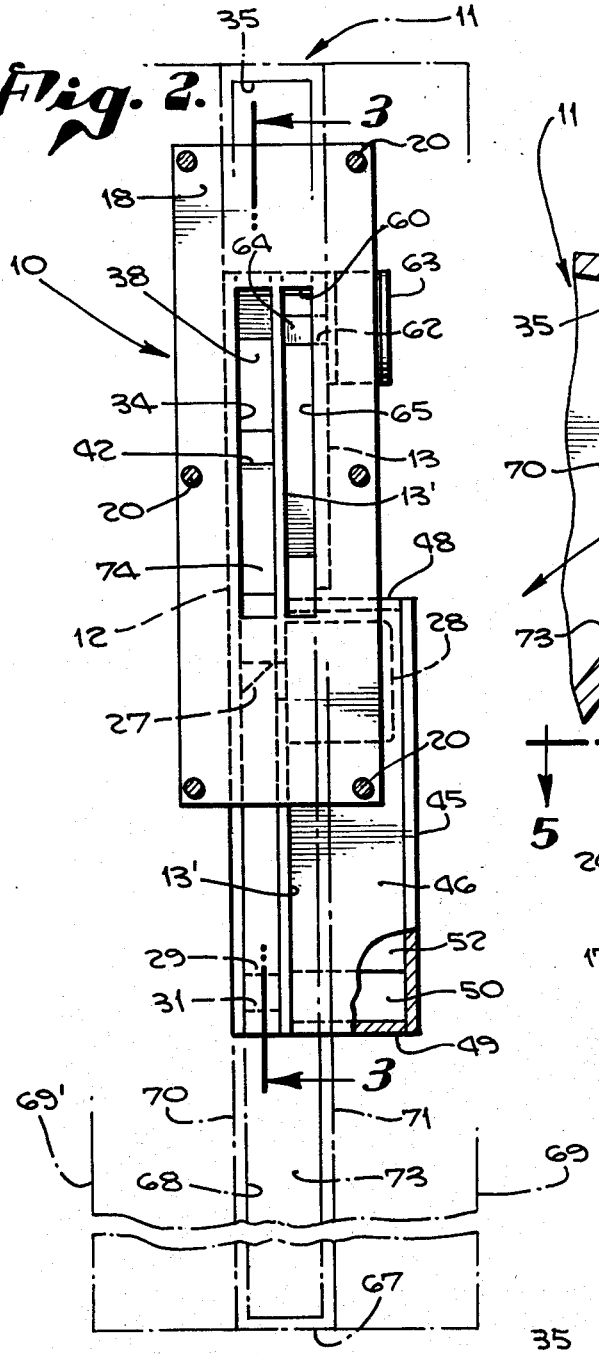
FIG. 2 is an end sectional view on the line 2—2 of FIG. 1.

In the chosen embodiment, the horn sections just described are substantially rectangular in cross-section, as can be observed in FIG. 2. As a consequence, the horn consists of four flat sides, the rectangular size being one progressively expanding from the beginning of the horn section 32 until the horn reaches the low frequency opening 34.

The drivers 26 and 28 may be contained separately within a housing defined by a side wall 45, end walls 46 and 47, a top wall 48 and bottom wall 49. Surrounding the driver 26 is a space 50 and a corresponding space 51 surrounds the driver 28. Access may be had to the drivers by making the side wall 45 removable if desired. A structural partition 52 is provided between the space 50 and the space 51.

Figure 4:
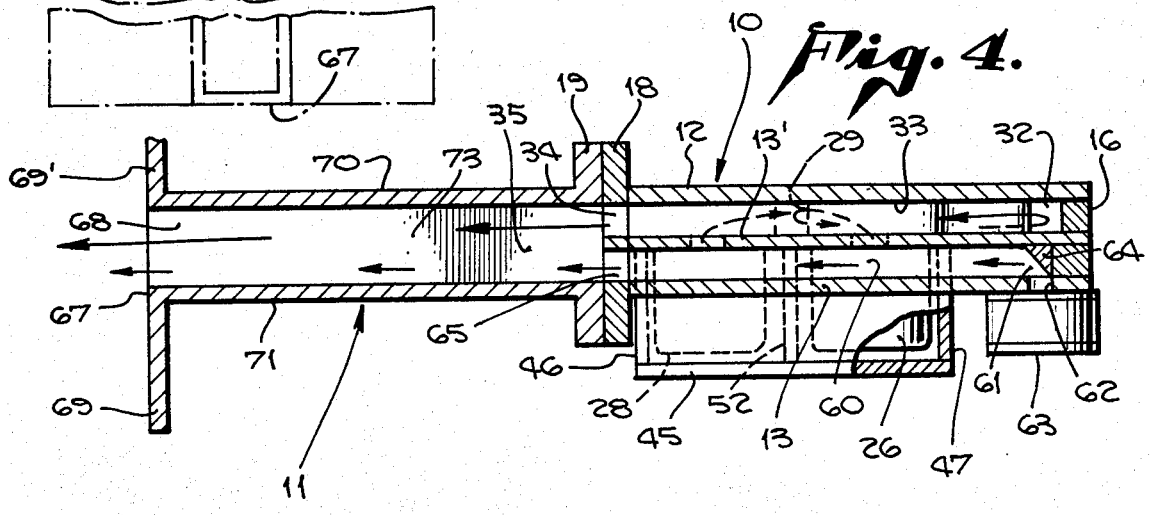
FIG. 4 is a cross-sectional view on the line 4—4 of FIG. 1.

For sounds in the high frequency range there is provided an entirely separate single horn section 60, shown in FIG. 1. This likewise has a substantially rectangular cross-sectional shape of size expanding progressively from the smallest end 61 immediately opposite a high range driver inlet 62 which is supplied by a high frequency driver 63. The high frequency driver 63 in the embodiment shown is mounted on the exterior side wall 13. A deflector 64, at the junction of the high frequency driver chamber 62 and the horn 60 serves to redirect the sound outwardly toward a high frequency opening 65. Separating the horn sections of the low frequency horn from the single high frequency horn section 60, is the intermediate partition 13' shown in section in FIG. 4. The intermediate partition 13' actually serves as an agency on which the low frequency drivers 26 and 28 are actually mounted.

Although there could be occasions when a horn housing like the horn housing 11 could be dispensed with, thereby to permit low frequency and high frequency to emerge side-by-side from the respective low frequency and high frequency openings, the throat 35 of the horn housing 11 in the chosen embodiment, frequently designated as a bell, does collect the low frequency and high frequency sounds emerging from the respective openings and transport them together through a throat or bell, substantially rectangular in cross-sectional shape, which expands progressively from the area of the flange 19 to an end edge 67 of a compound opening 68. As shown, the horn housing 11 is made up of opposite side plates 70 and 71 at the upper edges of which is an end plate 72 and at the lower edges of which is an end plate 73. Flanges 69, 69' extending right angularly outwardly on respective opposite sides of the compound opening 68 of the horn 11 improve the low frequency response.

Further by way of explanation of the structure helping to form the low frequency horn sections, attention is directed to elongated wall sections 74 and 75, serving as parts of the output wall structure, lying between the exterior side wall 12 and the intermediate partition 13'. The block 76 may also be considered as a spacer. A spacer 77 forming the bottom of the high frequency horn section 60 separates the exterior side wall 13 from the intermediate partition 13'.

The ultimate accomplishment of the structure just described provides a low frequency horn which is more or less three times as long as the high frequency horn, the distance being measured from the driver in each case to the respective low frequency and high frequency openings. The length of the horn housing 11 and its throat is common to both high frequency and low frequency horn sections.

Figure 6:
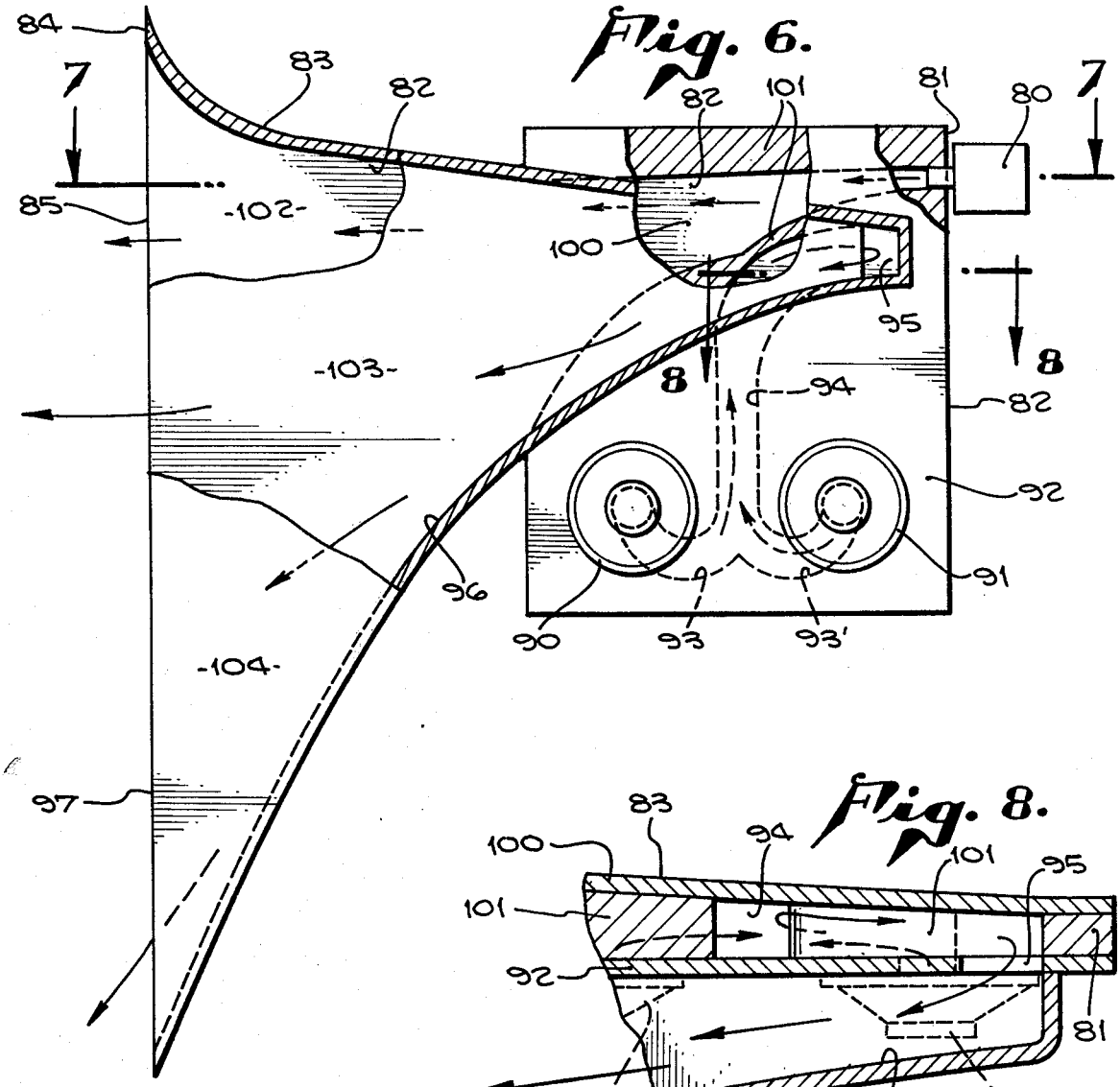
FIG. 6 is a side view partially in section of the second form of the device.
Figure 8:
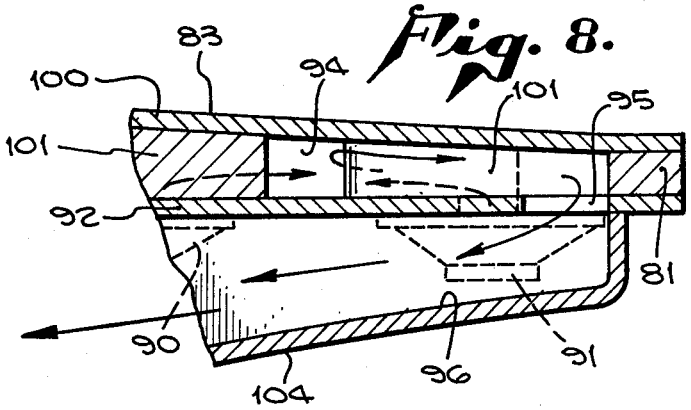
FIG. 8 is a fragmentary transverse sectional view on the line 8—8 of FIG. 6.
Figure 7:
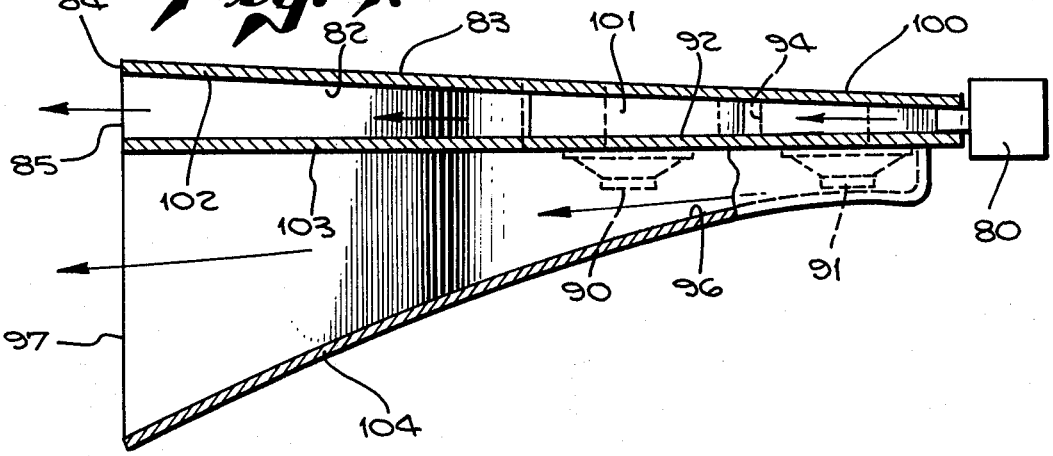
FIG. 7 is a transverse sectional view on the line 7—7 of FIG. 6.

A slightly modified form of the invention is shown in FIGS. 6, 7, and 8 wherein a high frequency driver 80 is mounted on a rear wall 81 facing in a direction to project high frequency sound waves into a high frequency horn 82. The high frequency horn 82 has a cross-sectional shape which expands progressively from the end adjacent the high frequency driver 80 to the opposite end and wherein the shape of the wall on the lower side of the horn varies to a degree. This variation is of an incidental character to satisfy certain incidental needs without influencing the overall combination. In this instance, the high frequency horn extends all the way through a horn housing 83 to the outer edge 84 of the horn housing where a high frequency outlet 85 is located. It should also be noted in this form that the cross-sectional shape of the high frequency horn progressively expands both laterally and vertically, the lateral expansion being evident in FIG. 7 and the vertical expansion being evident in FIG. 6.

In this form of the invention also there are provided two low frequency drivers 90 and 91, mounted on a wall section 92, and which project sound of low frequency into respective horn sections 93 and 93' which join a common low frequency horn section 94. The common low frequency horn section 94 then traverses a 180° corner section 95 and then travels forward through the low frequency horn section 96. Ultimately the low frequency sound emerges from a low frequency outlet opening 97 which is on the same plane as the high frequency outlet opening 85. Here again, it should be noted that the low frequency horn section 96 has a cross-sectional shape which expands progressively in both horizontal and vertical directions at least from the corner section 95 to the low frequency outlet opening 97, the lateral expansion being evident in FIG. 7 and the vertical expansion being evident in FIG. 6.

Structural details have been omitted to a degree in FIGS. 6, 7 and 8, inasmuch as the structural details will vary from time to time depending on the material from which the dual speaker is constructed as well as the manner in which it is constructed. For reference purposes, one outside wall of the high frequency horn is the wall 100 opposite which is the wall 101 referred to previously as an intermediate partition. The intermediate partition or wall 101 is also one side wall of the low frequency horn section 96, the opposite side comprising the wall 102. In any event, as readily appears from FIG. 6, the length of the high frequency horn is appreciably shorter than the length of the low frequency horn. Here, however, there is no common joining of the two horns in a progressively expanding bell, but rather both horns travel separately to the point of emergence.

Having described the invention, what is claimed as new in support of Letters Patent is as follows:

1. A dual speaker for emitting sounds originating in an electronic circuit comprising a housing, a side wall structure, a rear wall structure and an output wall structure, a low frequency driver chamber for reception of a low frequency driver unit, a low frequency outlet opening adjacent the output wall structure for emission of low frequency sounds, and a relatively long circuitous low frequency horn from the low frequency driver chamber to the low frequency outlet opening and forming a clear passage therethrough for sound, a high frequency driver chamber for reception of a high frequency driver unit, a high frequency outlet opening adjacent the output wall structure for emission of high frequency sounds and a relatively short direct high frequency horn from the high frequency driver chamber to the high frequency outlet opening and forming a clear passage therethrough for sound, there being a common partition between said horns, said outlet openings being in relatively the same plane.

2. A dual speaker as in claim 1 wherein the outlet openings are substantially rectangular with the length of long sides exceeding by several times the length of short sides, said long sides being in spaced parallel relationship.

3. A dual speaker as in claim 1 wherein mountings for the respective low frequency and high frequency driver units are on respective different portions of the side wall structure.

4. A dual speaker as in claim 1 wherein the low frequency horn is at least twice as long as the high frequency horn.

5. A dual speaker as in claim 1 wherein the low frequency horn has successive sections with the long axes of said sections extending in different directions relative to each other and wherein some sections of the low frequency horn have the long axes parallel to each other and some sections have the long axes transverse to each other.

6. A dual speaker as in claim 5 wherein some of said sections are substantially parallel to each other and to the long axis of the high frequency horn and some of said sections are transverse to each other and to the long axis of the high frequency horn.

7. A dual speaker as in claim 6 wherein one side wall section for the low frequency horn lies in a laterally diverging direction.

8. A dual speaker as in claim 1 wherein walls of said low frequency horn comprise portions of said side wall structure and walls of said high frequency horn comprise portions of said side wall structure, and wherein adjacent walls of, respectively, said low frequency horn and said high frequency horn comprise said common partition.

9. A dual speaker as in claim 8 wherein there is a bell common to said low frequency and high frequency horns, said bell having a small input end coincident with outlet ends of said low frequency and high frequency horns and a larger output end remote therefrom.

* * * * *